US007540254B2

(12) United States Patent
Hystad

(10) Patent No.: US 7,540,254 B2
(45) Date of Patent: Jun. 2, 2009

(54) CHAIN OR WIRE STOPPER

(75) Inventor: Geir Hystad, Kopervik (NO)

(73) Assignee: Karmoy Winch AS, Kopervik (NO)

( * ) Notice: Subject to any disclaimer, the term of this patent is extended or adjusted under 35 U.S.C. 154(b) by 19 days.

(21) Appl. No.: 11/665,808

(22) PCT Filed: Oct. 14, 2005

(86) PCT No.: PCT/NO2005/000384

§ 371 (c)(1),
(2), (4) Date: Nov. 9, 2007

(87) PCT Pub. No.: WO2006/043821

PCT Pub. Date: Apr. 27, 2006

(65) Prior Publication Data

US 2008/0190344 A1 Aug. 14, 2008

(30) Foreign Application Priority Data

Oct. 20, 2004 (NO) ..... 20044486

(51) Int. Cl.
*B63B 21/18* (2006.01)

(52) U.S. Cl. ..... 114/199; 114/200

(58) Field of Classification Search ..... 114/218, 114/199, 200

See application file for complete search history.

(56) References Cited

U.S. PATENT DOCUMENTS 3,146,754 A * 9/1964 Ohnsman ..... 114/199
3,289,626 A * 12/1966 Petrie et al. ..... 114/200
4,093,042 A * 6/1978 Pradon ..... 188/67
4,278,041 A * 7/1981 Williams ..... 114/210
4,423,697 A 1/1984 Royset
4,603,649 A * 8/1986 Hystad ..... 114/199
4,862,821 A * 9/1989 Ballantyne ..... 114/293

FOREIGN PATENT DOCUMENTS

DE 32 39 056 A1 4/1984
DE 195 03 382 A1 8/1995
GB 2 147 261 A 5/1985

* cited by examiner

*Primary Examiner*—Stephen Avila
(74) *Attorney, Agent, or Firm*—Finnegan, Henderson, Farabow, Garrett and Dunner, L.L.P.

(57) ABSTRACT

A stopper device (1) for chain (2) or wire, especially for locking in position an anchor chain, tow wire or mooring wire, wherein the stopper consists of a pair of plates (3, 4) which can be pivoted up from the deck of a ship to be vertically positioned in a locked position relative to the deck, so that the plates (3, 4) form an angle ($\alpha$) relative to each other and with a gap (6) between an area of adjacent plate edges (3'; 4') on the pair of plates, wherein the gap is configured to match the thickness (t) of a chain link or a wire, wherein the pivoting movement of each plate is provided with the aid of a jack (7) in cooperation with a link mechanism (8; 9), and wherein the link mechanism (8; 9) in one end position causes a locking of the plate (3; 4) in the vertical position. A first (10) of the links in the link mechanism has an abutment area (11) designed to cooperate with a controllable, reciprocating locking bolt (121) for locking the first link (10) and thus the link mechanism in said one end position.

4 Claims, 2 Drawing Sheets

CHAIN OR WIRE STOPPER

The present invention relates to a stopper device for chain or wire, especially for locking in position an anchor chain, tow wire or mooring wire, wherein the stopper consists of a pair of plates which can be pivoted up from the deck of a ship to be vertically positioned in a locked position relative to the deck, so that the plates form an angle relative to each other and with a gap between an area of adjacent plate edges on the pair of plates, wherein the gap is configured to match the thickness of a chain link or a wire, wherein the pivoting movement of each plate is provided with the aid of a jack in cooperation with a link mechanism, and wherein the link mechanism in one end position causes a locking of the plate in the vertical position.

Stoppers are previously known wherein a pair of plates are pivoted up from the deck surface on a ship to be vertically positioned in relation to the ship's deck and to form a right angle to each other with their plate surfaces, and with a portion between adjacent plate edges on the pair of plates recessed to match the thickness of a chain link or a wire. Such wire will normally be provided with wire clamps for engagement with the plate pair of the stopper. Known stoppers of this type are manufactured by Triplex AS and by Plimsol Robertson Ltd. in Singapore.

These known solutions use a link mechanism and jack to move such stopper plates into an upright position, and in such a position the links in the link mechanism will ideally be positioned in a straight line, so that a load against the stopper plates will pass through the links, pivot pins and fixing means into the structure.

It will be understood that if at least one link in such a link mechanism moves slightly out of the straight line or the centre line extending through and transverse to the axes of rotation of the links, the link mechanism, when loaded, will come out of position, and the stopper plates will move towards the deck and at the same time release the chain or wire that is being held. Such a link mechanism is often of the "toggle-joint type", which in reality means that if a knee of the toggle joint is not completely straight, it will not have any locking force. This results in a highly dangerous situation where the chain or wire may suddenly fly loose. Serious accidents may then occur, and in fact there have even been fatal accidents as a result of such failure of the link mechanism when, inter alia, a toggle joint has come out of its centered, aligned position. Often, this will be directly related to wear of the bearings and pivot pins, resulting in slack and a great risk of non-linear alignment and position of the links in the link mechanism.

To prevent this from happening, the known systems have used one of two solutions:

In one of the solutions, the toggle joint which forms the articulated connection directly with a stopper plate is displaced a few millimeters above a central position, the joint thus coming above a "dead centre". Thus, a kind of self-locking occurs. But this locking method has its limitations because it is not possible to displace the joint more than a few millimeters out of the alignment that ought to exist for the axes of rotation of the pivotal joints to be located in the same plane. The last-mentioned is the case because if the displacement is too great, a locking will occur which cannot be released. There will quite simply be a jamming because the moment that is present becomes too great. A major operational limitation thus resides in the possibility of only having a displacement of a few millimeters. An unfavourable side of this is also that after some years' use and with wear of the bearings, pivot pins, links and drive cylinders, the displacement could easily and uncontrollably become more than these few millimeters, which means that the solution will gradually become useless or will require regular maintenance and costly replacement of components.

In the other solution a load reduction valve is used on the hydraulic jack. Such a valve is known, inter alia, from use on hoisting cranes. This valve prevents the hydraulic jack from collapsing, i.e., becoming shorter in length. In such a solution, the valve will prevent the hydraulic oil from escaping from the jack cylinder. This also means that if the toggle joint comes out of its ideal alignment, the hydraulic jack will stop its movement. However, this is a solution that will not work satisfactorily as experience shows that after a time hydraulic valves will have some leakage. Thus, such a hydraulic jack over time could collapse and become shorter in length, whereby the toggle joint will fail. There is also a chance of breaks in the hydraulic hose between the jack cylinder and the valve as such hoses can start to leak and otherwise become worn. This would cause the stopper to suddenly fail.

It is of utmost importance that the work on deck in connection with, e.g., anchor handling, can be done in a safe manner. Today's solutions that are based on the displacement of a toggle joint by just a few millimeters, or on the leak-tightness of the cylinder, valves and hoses of a hydraulic jack, have been found not to guarantee such safe operation as a toggle joint structure will collapse if it comes out of a certain alignment. In such a situation, personnel working in the deck will not have any advance warning before the collapse happens, and the risk of serious injuries, even fatal injuries, is therefore very high.

The object of the present invention is therefore the provision of a solution to ensure that the dangerous, operational problems that may arise, also involving a danger to human life and a risk of other severe injuries, are countered in a safe and effective manner.

According to the invention, the device is characterised in that a first of the links in the link mechanism has an abutment area designed to cooperate with a controllable, reciprocating locking bolt for locking the first link and thus the link mechanism in said one end position.

According to one embodiment of the device, the link mechanism is a toggle device consisting of said first link and a second link, wherein the first link at a first end area close to the pivotal connection with the first end of the second link is designed for hinged engagement with one end of the jack, and at a second end area of the first link is pivotally attached to a fixed structural part of the ship, and that the second link at its second end is pivotally attached to the back of the plate.

To ensure that the locking bolt is in the right position when the plates are to be locked or folded back down onto the deck in a normal manner, the locking bolt is adapted to cooperate with an inductive sensor for detecting the position of the bolt in relation to the abutment area of the first link.

The angle between the plates in the pair of plates is advantageously in the range of 60°-90°.

The invention will now be described in more detail with reference to the attached drawings.

Figure 8:
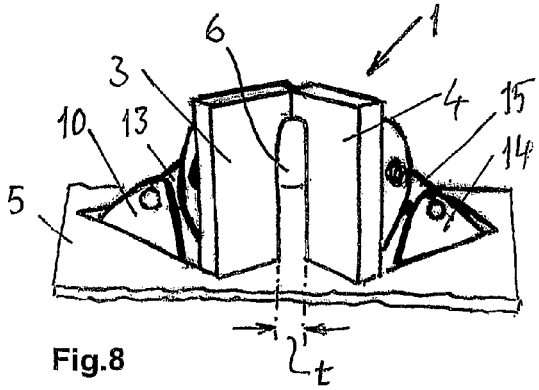
FIG. 8 shows a pair of plates in the stopper, wherein the plates are in the vertical, locked position.
Figure 12:
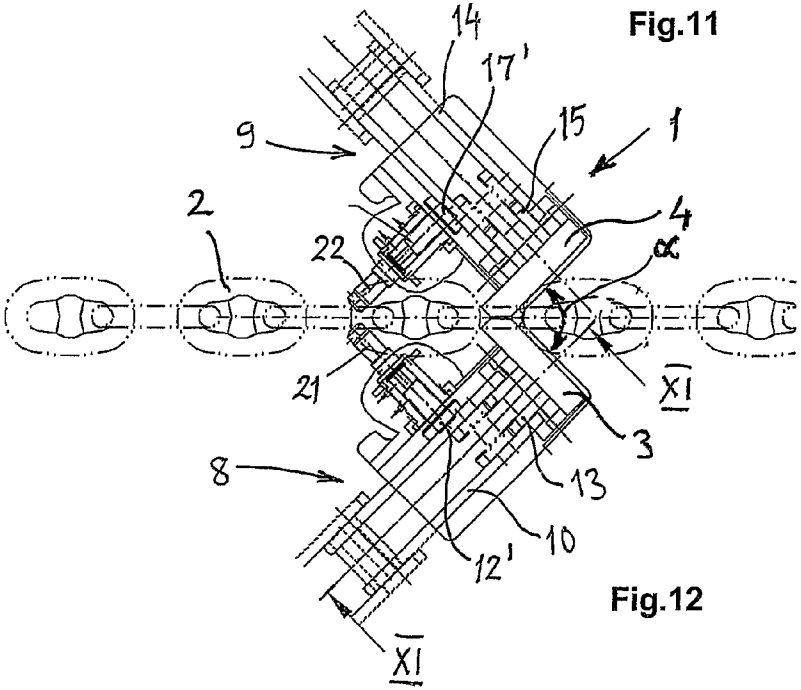
FIG. 12 is a top view of the stopper with locking bolt devices and with the pair of plates in the vertical, locked position for locking, e.g., a chain.

The stopper 1 is shown schematically in FIG. 8, whilst FIG. 12 is a top view thereof for further understanding of the mode of operation together with a chain 2. The stopper is primarily intended for use in stopping the movement of a chain in the longitudinal direction thereof, but if a wire (not shown) is equipped with clamp(s) (not shown) on the wire, arranged at one or more points along the length thereof, the stopper could also be used for wire. The stopper is designed in particular for locking in position an anchor chain, tow wire or mooring wire.

The stopper consists of a pair of plates 3, 4 which can be pivoted up from the deck 5 of a ship to be vertically positioned in a locked position relative to the deck 5, so that the //plates form an angle a relative to each other, preferably in the range of 60°-90°. A gap 6 is formed in an area between adjacent plate edges 3', 4' on the plate pair, and the gap 6 is configured to match the thickness t of a chain link or a wire.

The pivoting movement of each plate 3; 4 is provided by means of a jack 7 in cooperation with a respective link mechanism 8; 9 (see FIG. 12). The function of the link mechanism will be described in more detail in connection with one of these, namely the mechanism 8, as shown in FIGS. 1-7, 9 and 11. A similar function is of course present for the mechanism 9 for movement of the plate 4.

Figure 1:
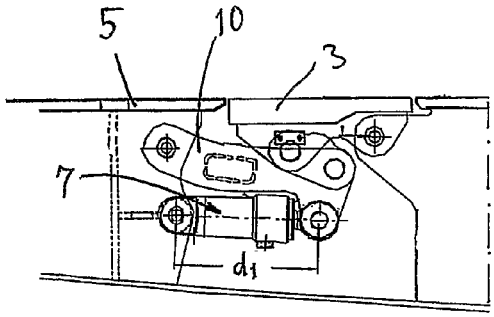
FIGS. 1-7 illustrate in stages the movement of a plate in a pair of plates from the horizontal position to a vertical, locked position.
Figure 2:
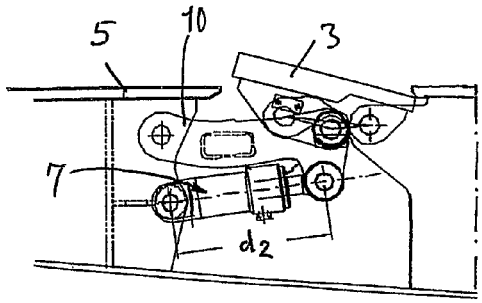
Figure 3:
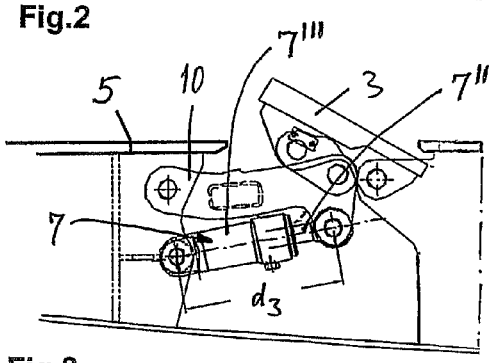
Figure 4:
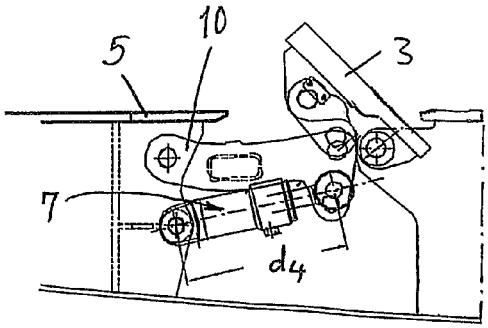
Figure 5:
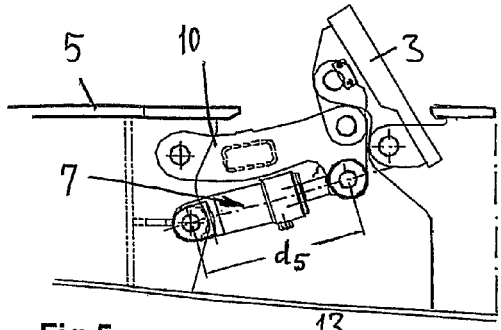
Figure 6:
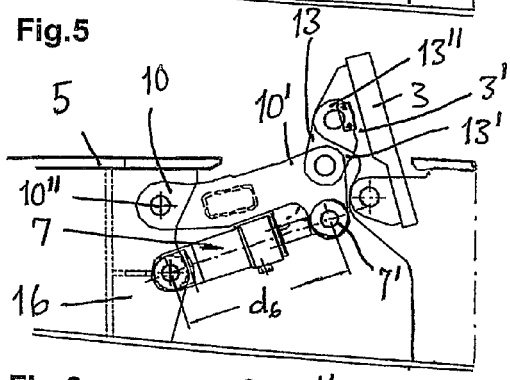
Figure 7:
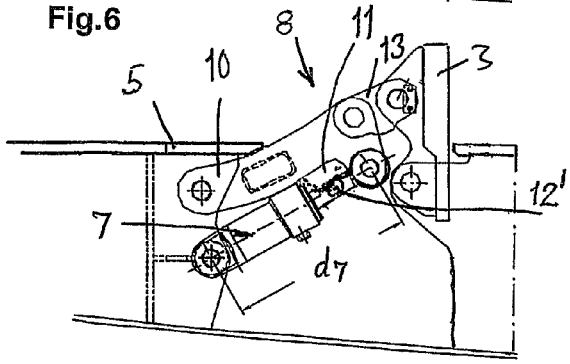
Figure 9:
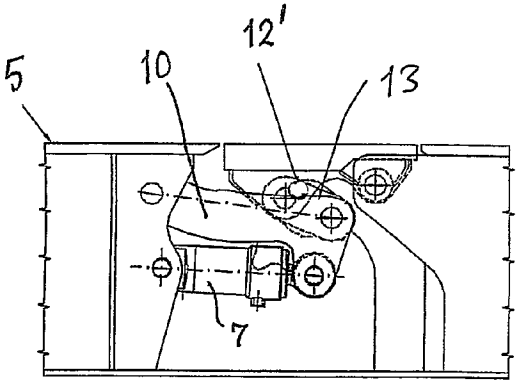
FIG. 9 shows the same as FIG. 1, but with the position of the locking bolt indicated.

The link mechanism 8 will in one end position as shown in FIGS. 7 and 9 cause a locking of the respective plate 3 in the vertical position.

A first link 10 of the link mechanism 8 has an abutment area 11 designed for cooperation with a controllable reciprocating locking bolt 12' in a locking bolt device 12 for locking the first link 10 and thus the link mechanism 8 in said one end position.

The link mechanism 8 is a toggle mechanism consisting of said first link 10 and second link 13. Similarly, the link mechanism 9 has a first link 14 and a second link 15 (see FIG. 12).

The first link 10 is at a first end area 10' close to the pivotal connection to a first end 13' of the second link 13 designed for hinged engagement with one end 7' of the jack 7, and at a second end area 10" on the first link 10 is pivotally attached to a fixed structural part 16 of the ship. The second link 13 is at its second end 13' pivotally attached to the back 3' of the plate 3.

Figure 10:
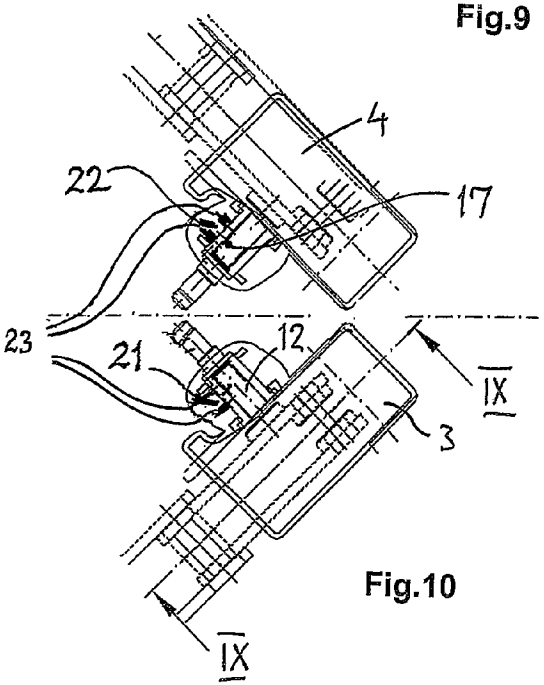
FIG. 10 is a top view of the stopper with locking bolt devices.

In FIGS. 10 and 12 there are two locking bolt devices 12; 17 for the link mechanisms 8, 9, respectively, and where the locking bolts are indicated by the reference numerals 12' and 17'.

In FIGS. 1-7 it is seen clearly how the locking mechanism 8 moves as the piston rod 7" moves out of the cylinder part 7'" of the jack 7 from the starting distance d1 to the end distance d7.

Figure 11:
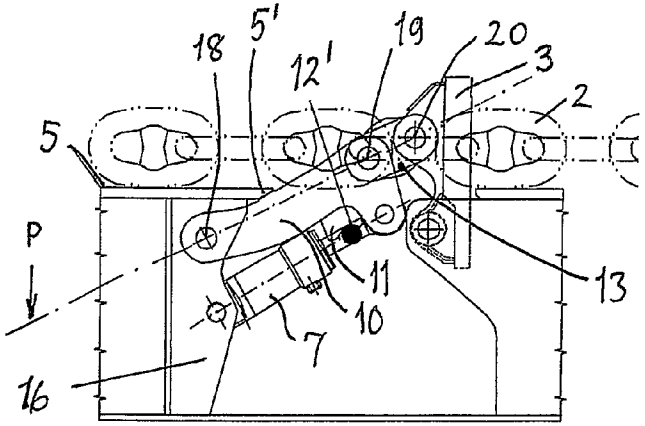
FIG. 11 shows the same as FIG. 7 but with a locked chain also indicated.

In the illustrated position in FIG. 11, it will be seen that the pivotal joints 18, 19, 20 all lie in the same plane P. Thus, the link mechanism is in a ideally aligned locking position, and in this position the moment load on the jack 7 is minimal. The upwards movement of the link 10 is limited by the edge 5' of the deck 5, and when the locking bolt 12' comes into contact with the abutment area 11 on the first link 10, the potential downward movement of the link 10 is locked.

The locking bolt devices 12; 17 are adapted to cooperate with a respective inductive sensor 21; 22 for detecting the position of the bolt 12' in relation to the abutment area 11 on the first link 10. The sensors 21; 22 are expediently connected to a signal device 23 which is adapted to give a signal indication of respective link mechanism or both link mechanisms simultaneously, e.g., so that a safety indication, e.g., by means of a light signal, is given when both locking bolts 12' and 17' are in operation.

It will be understood here that with the locking bolt in position and in engagement with the abutment area, the link mechanism will be immobile, even if the pivotal joints 18-20 are not in exactly the same plane, or in the event that there is a failure of the jack 7 or its supply lines (not shown).

To fold down the plates 3; 4 of the stopper, the locking bolts 12'; 17' must first be withdrawn, whereupon the jack can enter into operation and move the distance d7-d1.

The invention claimed is:

1. A stopper device (1) for chain (2) or wire, especially for locking in position an anchor chain, tow wire or mooring wire, wherein the stopper (1) consists of a pair of plates (3, 4) which can be pivoted up from the deck (5) of a ship to be vertically positioned in a locked position relative to the deck, so that the plates form an angle (α) relative to each other and with a gap (6) between an area of adjacent plate edges on the pair of plates, wherein the gap (6) is configured to match the thickness of a chain link or a wire, wherein the pivoting movement of each plate is provided with the aid of a jack (7) in cooperation with a link mechanism (8; 9), and wherein the link mechanism (8; 9) in one end position causes a locking of the plate (3; 4) in the vertical position, characterised in that a first (10; 14) of the links in the link mechanism (8; 9) has an abutment area (11) designed to cooperate with a controllable, reciprocating locking bolt (12'; 17') for locking the first link (10; 14) and thus the link mechanism (8; 9) in said one end position.

2. A device as disclosed in claim 1, characterised in that the link mechanism (8; 9) is a toggle device consisting of said first link (10; 14) and a second link (13; 15), wherein the first link (10; 14) at a first end area (10') close to the pivotal connection with the first end (13') of the second link (13; 15) is designed for hinged engagement with one end of the jack (7), and at a second end area (10") of the first link (10; 14) is pivotally attached to a fixed structural part (16) of the ship, and that the second link (13; 15) at its second end (13") is pivotally attached to the back (3') of the plate (3; 4).

3. A device as disclosed in claim 1 or 2, characterised in that the locking bolt (12'; 17') is adapted to cooperate with an inductive sensor (21; 22) for detecting the position of the bolt in relation to the abutment area (11) of the first link (10; 14).

4. A device as disclosed in claim 1, characterised in that the said mutual angle (α) is in the range of 60°-90°.

* * * * *